US011335286B2

(12) United States Patent
Wu

(10) Patent No.: US 11,335,286 B2
(45) Date of Patent: May 17, 2022

(54) DISPLAY PANEL AND DISPLAY DEVICE FOR SOLVING UNEVEN BRIGHTNESS OF DISPLAY PANEL

(71) Applicants: HKC CORPORATION LIMITED, Shenzhen (CN); CHONGQING HKC OPTOELECTRONICS TECHNOLOGY CO., LTD., Chongqing (CN)

(72) Inventor: Chuan Wu, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 692 days.

(21) Appl. No.: 16/319,481

(22) PCT Filed: Dec. 12, 2018

(86) PCT No.: PCT/CN2018/120617
§ 371 (c)(1),
(2) Date: Jan. 22, 2019

(87) PCT Pub. No.: WO2020/113641
PCT Pub. Date: Jun. 11, 2020

(65) Prior Publication Data

US 2021/0358433 A1 Nov. 18, 2021

(30) Foreign Application Priority Data

Dec. 5, 2018 (CN) ..... 201822035589.5

(51) Int. Cl.
*G09G 3/36* (2006.01)

(52) U.S. Cl.
CPC ... *G09G 3/3614* (2013.01); *G09G 2300/0452* (2013.01); *G09G 2320/0233* (2013.01)

(58) Field of Classification Search
CPC ..... G09G 3/3614; G09G 2300/0452; G09G 2320/0233
See application file for complete search history.

(56) References Cited

U.S. PATENT DOCUMENTS

2004/0252249 A1* 12/2004 Hong ..... G09G 3/3614 349/37
2006/0145990 A1* 7/2006 Kim ..... G02F 1/134363 345/94

(Continued)

FOREIGN PATENT DOCUMENTS

CN 101685228 A 3/2010
CN 104503171 A 4/2015

(Continued)

OTHER PUBLICATIONS

International Search Report issued in corresponding Interational application No. PCT/CN2018/120617, dated Aug. 27, 2019(7 pages).

(Continued)

*Primary Examiner* — Kwang-Su Yang

(57) ABSTRACT

The present application discloses a display panel and a display device. The display panel includes a substrate, and the substrate is provided thereon with a plurality of data lines. The data lines include an odd-numbered column of data lines and an even-numbered column of data lines. A line width of the odd-numbered column of data lines is greater than a line width of the even-numbered column of data lines.

11 Claims, 4 Drawing Sheets

(56) References Cited

U.S. PATENT DOCUMENTS

| | | | | |
|---|---|---|---|---|
| 2011/0205260 | A1* | 8/2011 | Weng | G09G 3/3648 345/691 |
| 2012/0025198 | A1* | 2/2012 | Ho | H01L 27/124 257/72 |
| 2013/0127796 | A1* | 5/2013 | Li | G09G 3/3648 345/204 |

FOREIGN PATENT DOCUMENTS

| | | | |
|---|---|---|---|
| CN | 104700794 | A | 6/2015 |
| CN | 106991953 | A | 7/2017 |
| KR | 20040057893 | A | 7/2004 |
| KR | 20100060578 | A | 6/2010 |
| KR | 108878453 | A | 11/2018 |

OTHER PUBLICATIONS

Written Opinion of the International Searching Authority for No. PCT/CN2018/120617.

* cited by examiner

DISPLAY PANEL AND DISPLAY DEVICE FOR SOLVING UNEVEN BRIGHTNESS OF DISPLAY PANEL

The present application claims priority to the Chinese Patent Application No. CN201822035589.5, filed with the Chinese Patent Office on Dec. 5, 2018 and entitled "DISPLAY PANEL AND DISPLAY DEVICE", which is incorporated herein by reference in its entirety.

TECHNICAL FIELD

The present application relates to the technical field of display, and in particular, to a display panel and a display device.

BACKGROUND

The statements herein merely provide background information related to the present application and do not necessarily constitute the prior art.

With the development and advancement of technologies, liquid crystal displays have become mainstream products of displays due to their thin body, low power consumption and low radiation, and thus have been widely used. Most of the liquid crystal displays currently available on the market are backlight liquid crystal displays, which include a display panel and a backlight module. The working principle of the display panel is to place liquid crystal molecules in two parallel glass substrates, and apply driving voltages on the two glass substrates to control the rotation direction of the liquid crystal molecules to refract the light of the backlight module to generate a picture.

Half-Source Driver (HSD) technology is a low-cost production solution commonly used in the display panel industry. This solution doubles the number of scanning lines so that a single data line can correspond to sub-pixels of two adjacent columns, thereby saving half of the source driving integrated chips, but the case of vertical bright-dark lines would occur.

SUMMARY

An objective of the present application is to provide a display panel and a display device for solving uneven brightness of the display panel.

To achieve the foregoing objective, the present application provides a display panel, including:

a substrate including a display region and a non-display region;

the substrate is provided thereon with:

a plurality of data lines, a plurality of gate lines, and a plurality of pixels;

the pixels includes sub-pixels of different colors respectively disposed along the direction of the gate lines;

the pixels adopt a two-column reverse driving manner;

each row of the pixels includes a plurality of pixel groups; each of the plurality of pixel groups includes an anterior first column of pixels and a posterior second column of pixels adjacent to each other; the first column of pixels and the second column of pixels are connected to the same data line; and the first column of pixels and the second column of pixels are connected to two different gate lines;

the polarities of data driving signals adopted by each pixel group and an adjacent pixel group in each row of the pixels are opposite;

the data lines include a first data line coupled to the first column of pixels and a second data line coupled to the second column of pixels;

a line width of the first data line is greater than a line width of the second data line.

Optionally, the polarities of data driving voltages corresponding to the first column of pixels and the second column of pixel are the same, the first column of pixels is an odd-numbered column of pixels, and the second column of pixels is an even-numbered column of pixels; the data lines include an odd-numbered column of data lines coupled to the odd-numbered column of pixels and an even-numbered column of data lines coupled to the even-numbered column of pixels; and the line width of the odd-numbered column of data lines is greater than the line width of the even-numbered column of data lines.

Optionally, a line width of the odd-numbered column of data lines is x1, and x1 is at least equal to 2 μm and no more than 20 μm; a line width of the even-numbered column of data lines is x2, and x2 is at least equal to 2 μm and no more than 20 μm.

Optionally, the difference between the line width of the odd-numbered column of data lines and the line width of the even-numbered column of data lines is x3, and x3 is at least equal to 1 μm and no more than 5 μm.

Optionally, x3 is one of 1 μm, 2 μm, or 3 μm.

Optionally, the odd-numbered column of data lines and the even-numbered column of data lines are combined into one data line in the non-display region, and are connected to a driving integrated circuit.

Optionally, the odd-numbered column of data lines and the even-numbered column of data lines are separately connected to the driving integrated circuit, and the driving integrated circuit separately outputs a same data signal to the odd-numbered column of data lines and the even-numbered column of data lines.

Optionally, wirings of the gate lines and the data lines are of a single-layer metal, alloy or laminated structure; a wiring of the odd-numbered column of data lines and a wiring of the even-numbered column of data lines are made of different materials, and the electrical resistivity of the wiring of the odd-numbered column of data lines is less than the electrical resistivity of the wiring of the even-numbered column of data lines.

The present application discloses a display panel, including:

a substrate including a display region and a non-display region;

the substrate is provided thereon with:

a plurality of data lines, a plurality of gate lines, and a plurality of pixels;

the pixels includes sub-pixels of different colors respectively disposed along the direction of the gate lines;

the pixels adopt a two-column reverse driving manner;

each row of the pixels includes a plurality of pixel groups; each of the plurality of pixel groups includes an anterior first column of pixels and a posterior column of pixels adjacent to each other; the first column of pixels and the second column of pixels are connected to the same data line; and the first column of pixels and the second column of pixels are connected to two different gate lines;

the polarities of data driving signals adopted by each pixel group and an adjacent pixel group in each row of the pixels are opposite;

the polarities of data driving voltages corresponding to the first column of pixels and the second column of pixel are the same, the first column of pixels is an odd-numbered column of pixels, and the second column of pixels is an even-numbered column of pixels;

the data lines include an odd-numbered column of data lines coupled to the odd-numbered column of pixels and an even-numbered column of data lines coupled to the even-numbered column of pixels;

the odd-numbered column of data lines and the even-numbered column of data lines are combined into one data line in the non-display region, and are connected to a driving integrated circuit;

a line width of the odd-numbered column of data lines is x1, and x1 is at least equal to 2 μm and no more than 20 μm; a line width of the even-numbered column of data lines is x2, and x2 is at least equal to 2 μm and no more than 20 μm;

the line width of the odd-numbered column of data lines is greater than the line width of the even-numbered column of data lines;

the difference between the line width of the odd-numbered column of data lines and the line width of the even-numbered column of data lines is x3, and x3 is one of 1 μm, 2 μm, or 3 μm.

The present application further discloses a display device, including the display panel above.

When the data lines enter the display region, the data lines are divided into two columns of wirings, i.e., divided into a first data line and a second data line. Since the second data line is disturbed by a data line signal of a same polarity, the voltage increases, and as a result, the second column of pixels is brighter, resulting in a bright-dark line. In this solution, a line width of the first data line is set to be greater than a line width of the second data line; the line width of the first data line is widened, and the resistance is small, so that the voltage loss of the first data line is reduced, and the voltage corresponding to the second data line and the voltage corresponding to the first data line tend to be the same, thereby achieving the same voltage, so that the brightness of the first column of pixels and the second column of pixels is balanced, and thus the situation of vertical bright-dark lines is prevented.

BRIEF DESCRIPTION OF DRAWINGS

The drawings are included to provide further understanding of embodiments of the present application, which constitute a part of the specification and illustrate the embodiments of the present application, and describe the principles of the present application together with the text description. Apparently, the accompanying drawings in the following description show merely some embodiments of the present application, and a person of ordinary skill in the art may still derive other accompanying drawings from these accompanying drawings without creative efforts. In the accompanying drawings.

DETAILED DESCRIPTION

Figure 1:
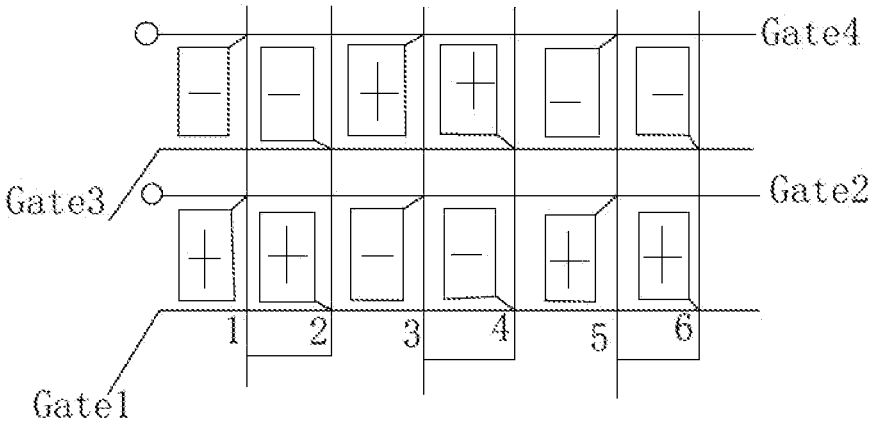
FIG. 1 is a schematic structural diagram of an HSD bright-dark line according to an embodiment of the present application.

The specific structure and function details disclosed herein are merely representative, and are intended to describe exemplary embodiments of the present application. However, the present application can be specifically embodied in many alternative forms, and should not be interpreted to be limited to the embodiments described herein.

In the description of the present application, it should be understood that, orientation or position relationships indicated by the terms "center", "transversal", "upper", "lower", "left", "right", "vertical", "horizontal", "top", "bottom", "inner", "outer", etc. are based on the orientation or position relationships as shown in the drawings, for ease of the description of the present application and simplifying the description only, rather than indicating or implying that the indicated device or element must have a particular orientation or be constructed and operated in a particular orientation. Therefore, these terms should not be understood as a limitation to the present application. In addition, the terms such as "first" and "second" are merely for a descriptive purpose, and cannot be understood as indicating or implying relative importance, or implicitly indicating the number of the indicated technical features. Hence, the features defined by "first" and "second" can explicitly or implicitly include one or more features. In the description of the present application, "a plurality of" means two or more, unless otherwise stated. In addition, the term "include" and any variations thereof are intended to cover a non-exclusive inclusion.

In the description of the present application, it should be understood that, unless otherwise specified and defined, the terms "install", "connected with", "connected to" should be comprehended in a broad sense. For example, these terms may be comprehended as being fixedly connected, detachably connected or integrally connected; mechanically connected or electrically connected; or directly connected or indirectly connected through an intermediate medium, or in an internal communication between two elements. The specific meanings about the foregoing terms in the present application may be understood by a person of ordinary skill in the art according to specific circumstances.

The terms used herein are merely for the purpose of describing the specific embodiments, and are not intended to limit the exemplary embodiments. As used herein, the singular forms "a", "an" are intended to include the plural forms as well, unless otherwise indicated in the context clearly. It will be further understood that the terms "comprise" and/or "include" used herein specify the presence of the stated features, integers, steps, operations, elements and/or components, but do not preclude the presence or addition of one or more other features, integers, steps, operations, elements, components and/or combinations thereof.

The present application is further described below with reference to the accompanying drawings and optional embodiments.

Figure 2:
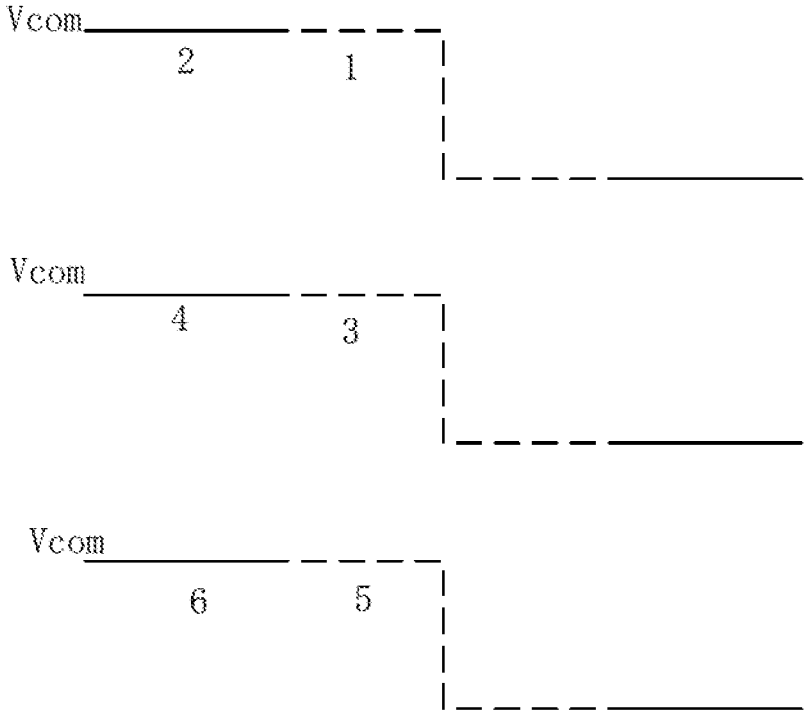
FIG. 2 is a schematic principle diagram of an HSD bright-dark line according to an embodiment of the present application.
Figure 3:
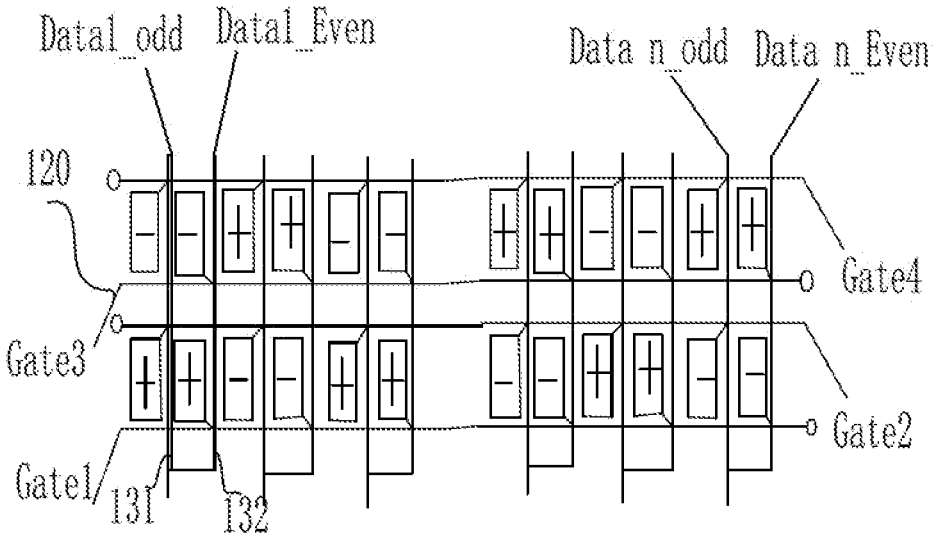
FIG. 3 is a schematic structural diagram (1) of a display panel for solving a bright-dark line according to an embodiment of the present application.
Figure 4:
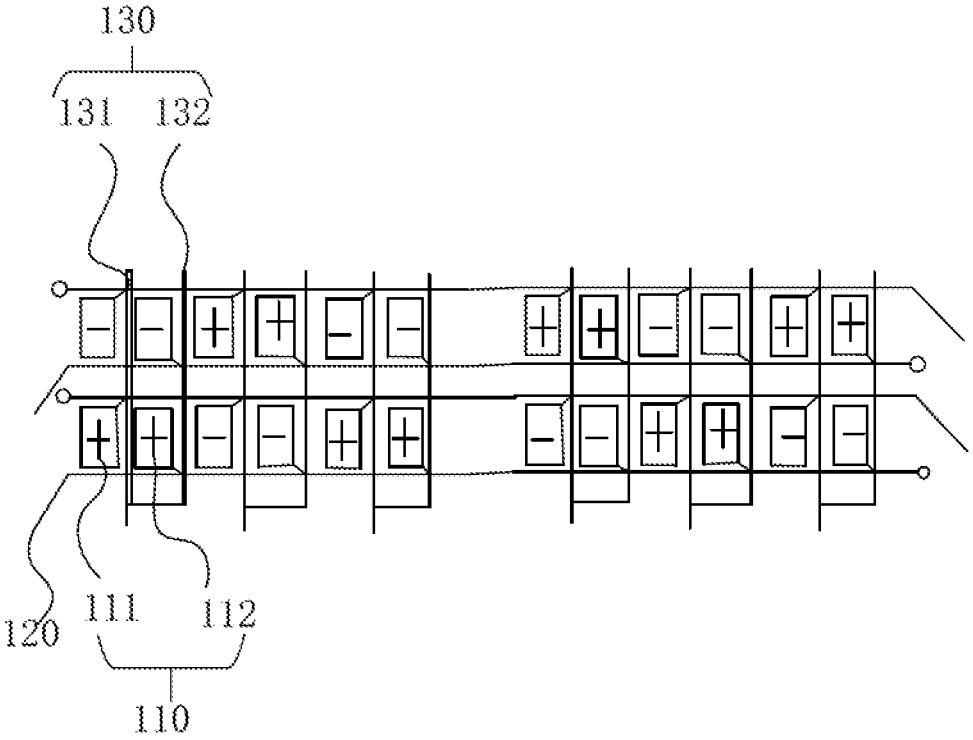
FIG. 4 is a schematic structural diagram (2) of a display panel for solving a bright-dark line according to an embodiment of the present application.
Figure 5:
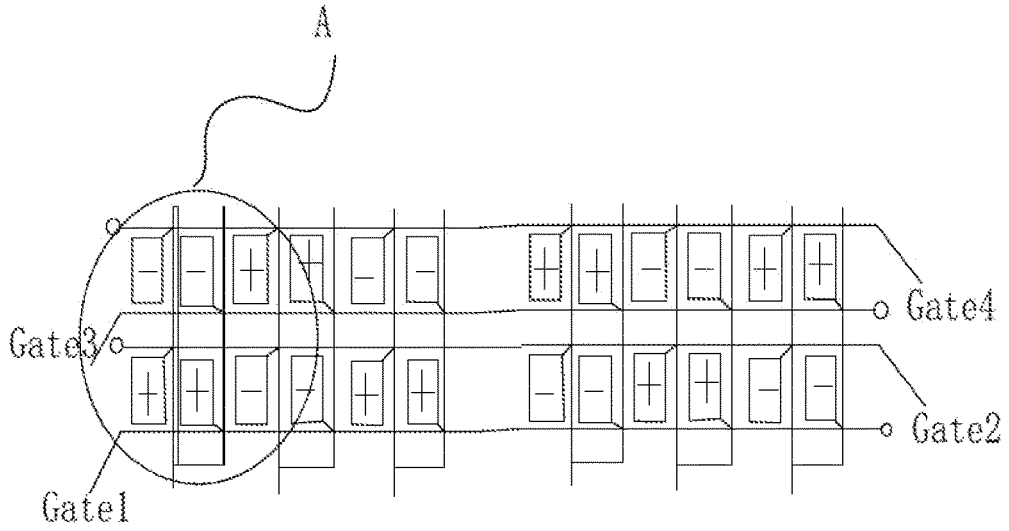
FIG. 5 is a schematic structural diagram (3) of a display panel for solving a bright-dark line according to an embodiment of the present application.
Figure 6:
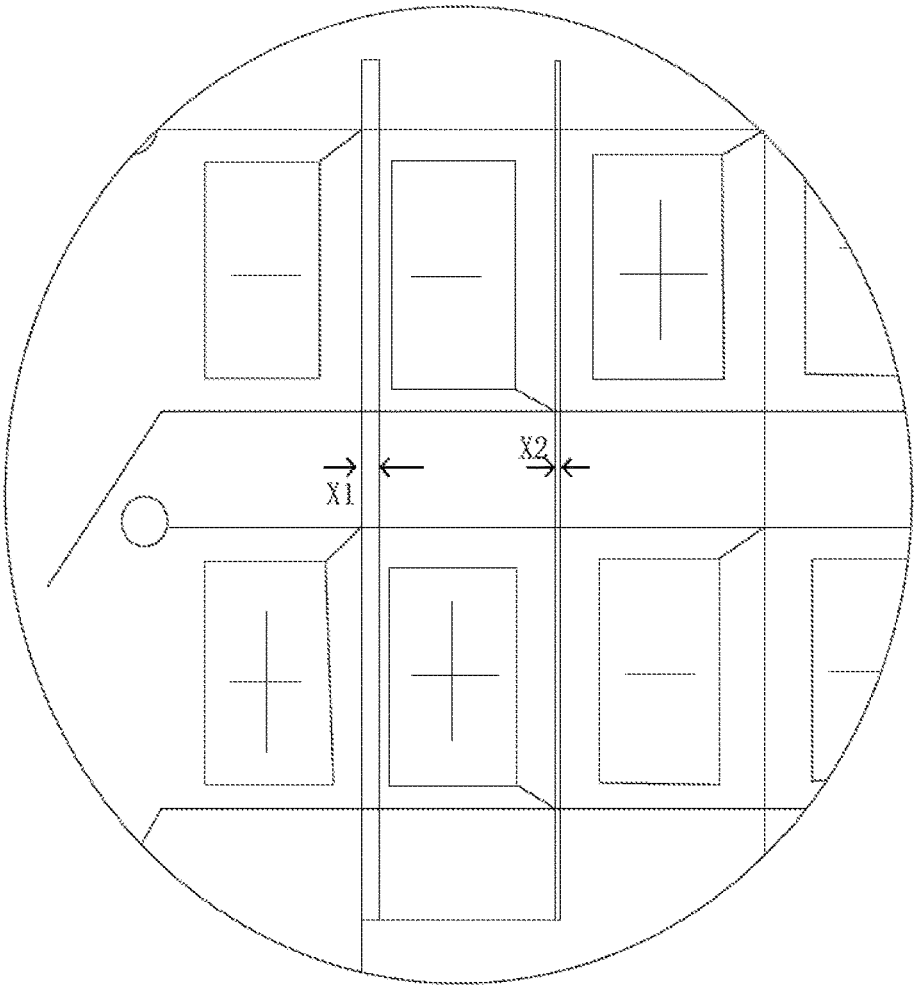
FIG. 6 is a partially enlarged schematic diagram of A of FIG. 5.

As shown in FIGS. 1 and 2, Gate1, Gate2, Gate3, and Gate4 are scanning lines; 1 and 2 are connected to a same data line; 3 and 4 are connected to a same data line; 5 and 6 are connected to a same data line; the polarities of two pixels connected to a same data line are the same; and two pixels of the same data line are respectively connected to different scanning lines. When Gate1 is turned on, a second pixel, a fourth pixel, and a sixth pixel connected to Gate1 are turned on, corresponding to three different vertical lines in a same column of FIG. 2. Then Gate2 is turned on, a first pixel, a third pixel, and a fifth pixel corresponding to Gate2 are turned on. After the scanning lines are turned on, the voltage of the second column of pixels is affected by two data lines adjacent thereto, and the data voltage disturbance of a same polarity increases the total voltage, and thus the total voltage of the second column of pixels increases, thereby becoming brighter. A third column of pixels is located between the second data line and the third data line, and the polarity there between is opposite. A positive value and a negative value are cancelled out, and relatively speaking, the total voltage remains unchanged. The brightness of the second column of pixels is brightened, while the brightness of the third column of pixels remains unchanged, thus producing a bright-dark line, where Vcom is a corresponding voltage.

As shown in FIGS. 3-6, an embodiment of the present application discloses a display panel, including:

a substrate including a display region and a non-display region;

the substrate is provided thereon with:

a plurality of data lines 130, a plurality of gate lines 120, and a plurality of pixels 110;

the pixels 110 includes sub-pixels of different colors respectively disposed along the direction of the gate lines 120;

the pixels 110 adopt a two-column reverse driving manner;

each row of the pixels 110 includes a plurality of pixel groups; each of the plurality of pixel groups includes an anterior first column of pixels 111 and a posterior second column of pixels 112 adjacent to each other; the first column of pixels 111 and the second column of pixels 112 are connected to the same data line 130; and the first column of pixels 111 and the second column of pixels 112 are connected to two different gate lines 120;

the polarities of data driving signals adopted by each pixel group and an adjacent pixel group in each row of the pixels are opposite;

the data lines 130 include a first data line 131 coupled to the first column of pixels 111 and a second data line 132 coupled to the second column of pixels 112;

a line width of the first data line 131 is greater than a line width of the second data line 132.

When the data lines enter the display region, the data lines are divided into two columns of wirings, i.e., divided into a first data line 131 and a second data line 132. Since the second data line 132 is disturbed by a data line signal of a same polarity, the voltage increases, and as a result, the second column of pixels 112 is brighter, resulting in a bright-dark line. In this solution, a line width of the first data line 131 is set to be greater than a line width of the second data line 132; the line width of the first data line 131 is widened, and the resistance is small, so that the voltage loss of the first data line 131 is reduced, and the voltage corresponding to the second data line 132 and the voltage corresponding to the first data line 131 tend to be the same, thereby achieving the same voltage, so that the brightness of the first column of pixels 111 and the second column of pixels 112 is balanced, and thus the situation of vertical bright-dark lines is prevented.

In an embodiment, the polarities of data driving voltages corresponding to the first column of pixels 111 and the second column of pixels 112 are the same, the first column of pixels 111 is an odd-numbered column of pixels, and the second column of pixels 112 is an even-numbered column of pixels;

the data lines include an odd-numbered column of data lines coupled to the odd-numbered column of pixels and an even-numbered column of data lines coupled to the even-numbered column of pixels;

a line width of the odd-numbered column of data lines is greater than a line width of the even-numbered column of data lines.

When the data lines enter the display region, the data lines are divided into two columns of wirings, i.e., divided into an odd-numbered column of data lines and an even-numbered column of data lines. Since the even-numbered column of data lines is disturbed by a data line signal of a same polarity, the voltage increases, and as a result, the even-numbered column of pixels is brighter, resulting in a bright-dark line. In this solution, a line width of the odd-numbered column of data lines is set to be greater than a line width of the even-numbered column of data lines; the line width of the odd-numbered column of data lines is widened, and the resistance is small, so that the voltage loss of the odd-numbered column of data lines is reduced, the voltage of the odd-numbered column of data lines is relatively increased, and the voltage corresponding to the odd-numbered column of data lines and the voltage corresponding to the even-numbered column of data lines tend to be the same, thereby achieving the same voltage as the even-numbered column of data lines, so that the brightness of the odd-numbered column of pixels and the even-numbered column of pixels is balanced, and thus the situation of vertical bright-dark lines is prevented.

If, due to the different architecture, it is the even-numbered column of pixels before the polarity is reversed and is an odd-numbered column of pixels after the polarity is reversed, the line width is reversed.

In an embodiment, a line width of the odd-numbered column of data lines is x1, and x1 is at least equal to 2 μm and no more than 20 μm; a line width of the even-numbered column of data lines is x2, and x2 is at least equal to 2 μm and no more than 20 μm.

In this solution, the range of the line width of the odd-numbered column of pixels and the line width of the even-numbered column of pixels is at least equal to 2 μm and no more than 20 μm; if the width of the line width is less than 2 μm, the line width is too small to be broken; and if the width of the line width is greater than 20 μm, the width of the line width is too large, as a result, the brightness is too bright, and the brightness balance effect cannot be achieved.

In an embodiment, the difference between the line width of the odd-numbered column of data lines and the line width of the even-numbered column of data lines is x3, and x3 is at least equal to 1 μm and no more than 5 μm.

The range of the line width of the odd-numbered column of pixels and the line width of the even-numbered column of pixels is at least equal to 1 μm and no more than 5 μm, which can solve the situation of vertical bright-dark line, and can ensure the overall brightness of the display panel 101, and the display effect is superior.

In an embodiment, x3 is one of 1 μm, 2 μm, or 3 μm.

The line width is one of 1 μm, 2 μm, or 3 μm, which can solve the situation of vertical bright-dark line, and can ensure the overall brightness of the display panel 101, and the display effect is superior.

In an embodiment, the odd-numbered column of data lines and the even-numbered column of data lines are combined into one data line in the non-display region, and are connected to a driving integrated circuit 102.

In this solution, the odd-numbered column of data lines and the even-numbered column of data lines are combined into one data line in the non-display region, and a source driving integrated circuit 102 is reduced by sharing one data line.

In an embodiment, the odd-numbered column of data lines and the even-numbered column of data lines are separately connected to the driving integrated circuit 102, and the driving integrated circuit 102 separately outputs a same data signal to the odd-numbered column of data lines and the even-numbered column of data lines.

In this solution, the odd-numbered column of data lines and the even-numbered column of data lines are separately connected to the driving integrated circuit 102, and the driving integrated circuit 102 separately outputs a same data signal to the odd-numbered column of data lines and the even-numbered column of data lines. The use of different utility models has basically achieved the technical effects of the known techniques of the inventors.

As another embodiment of the present application, as shown in FIGS. 3-6, disclosed is a display panel 101, including:

a substrate including a display region and a non-display region;

the substrate is provided thereon with:

a plurality of data lines, a plurality of gate lines 120, and a plurality of pixels;

the pixels include sub-pixels of different colors respectively disposed along the direction of the gate lines 120;

the pixels adopt a two-column reverse driving manner;

each row of the pixels includes a plurality of pixel groups; each of the plurality of pixel groups includes an anterior first column of pixels 111 and a posterior second column of pixels 112 adjacent to each other; the first column of pixels 111 and the second column of pixels 112 are connected to the same data line; and the first column of pixels 111 and the second column of pixels 112 are connected to two different gate lines 120;

the polarities of data driving signals adopted by each pixel group and an adjacent pixel group in each row of the pixels are opposite;

the polarities of data driving voltages corresponding to the first column of pixels 111 and the second column of pixel 112 are the same, the first column of pixels 111 is an odd-numbered column of pixels, and the second column of pixels 112 is an even-numbered column of pixels;

the data lines include an odd-numbered column of data lines coupled to the odd-numbered column of pixels and an even-numbered column of data lines coupled to the even-numbered column of pixels;

the odd-numbered column of data lines and the even-numbered column of data lines are combined into one data line in the non-display region, and are connected to a driving integrated circuit 102;

a line width of the odd-numbered column of data lines is x1, and x1 is at least equal to 2 μm and no more than 20 μm; a line width of the even-numbered column of data lines is x2, and x2 is at least equal to 2 μm and no more than 20 μm;

the line width of the odd-numbered column of data lines is greater than the line width of the even-numbered column of data lines;

the difference between the line width of the odd-numbered column of data lines and the line width of the even-numbered column of data lines is x3, and x3 is one of 1 μm, 2 μm, or 3 μm.

When the data lines enter the display region, the data lines are divided into two columns of wirings, i.e., divided into an odd-numbered column of data lines and an even-numbered column of data lines. Since the even-numbered column of data lines is disturbed by a data line signal of a same polarity, the voltage increases, and as a result, the even-numbered column of pixels is brighter, resulting in a bright-dark line. In this solution, a line width of the odd-numbered column of data lines is set to be greater than a line width of the even-numbered column of data lines; the line width of the odd-numbered column of data lines is widened, and the resistance is small, so that the voltage loss of the odd-numbered column of data lines is reduced, the voltage of the odd-numbered column of data lines is relatively increased, and the voltage corresponding to the odd-numbered column of data lines and the voltage corresponding to the even-numbered column of data lines tend to be the same, thereby achieving the same voltage as the even-numbered column of data lines, so that the brightness of the odd-numbered column of pixels and the even-numbered column of pixels is balanced, and thus the situation of vertical bright-dark lines is prevented.

In an embodiment, wirings of the gate lines and the data lines are of a single-layer metal, alloy or laminated structure;

a wiring of the odd-numbered column of data lines and a wiring of the even-numbered column of data lines are made of different materials, and the electrical resistivity of the wiring of the odd-numbered column of data lines is less than the electrical resistivity of the wiring of the even-numbered column of data lines.

In this solution, the wiring of the odd-numbered column of data lines and the wiring of the even-numbered column of data lines are set to be made of different materials, and the electrical resistivity of the wiring of the odd-numbered column of data lines is less than the electrical resistivity of the wiring of the even-numbered column of data lines. The electrical resistivity of the wiring of the odd-numbered column of data lines is small, so that the voltage loss of the odd-numbered column of data lines is reduced, the voltage of the odd-numbered column of data lines is relatively increased, and the voltage corresponding to the odd-numbered column of data lines and the voltage corresponding to the even-numbered column of data lines tend to be the same, thereby achieving the same voltage as the even-numbered column of data lines, so that the brightness of the odd-numbered column of pixels and the even-numbered column of pixels is balanced. The wiring structure is diverse and has a range of application, and thus can be applied to many different panels. In the case of using different materials, the line widths of two data lines can be actually the same, without burden, and the increase of the line width causes loss of light transmittance; even the line width of the odd-numbered column of data lines is less than the line width of the even-numbered column of data lines, and thus it is also possible to increase the light transmittance, and it is only needed to change the material of the odd-numbered column of data lines to a material having a smaller resistivity.

Figure 7:
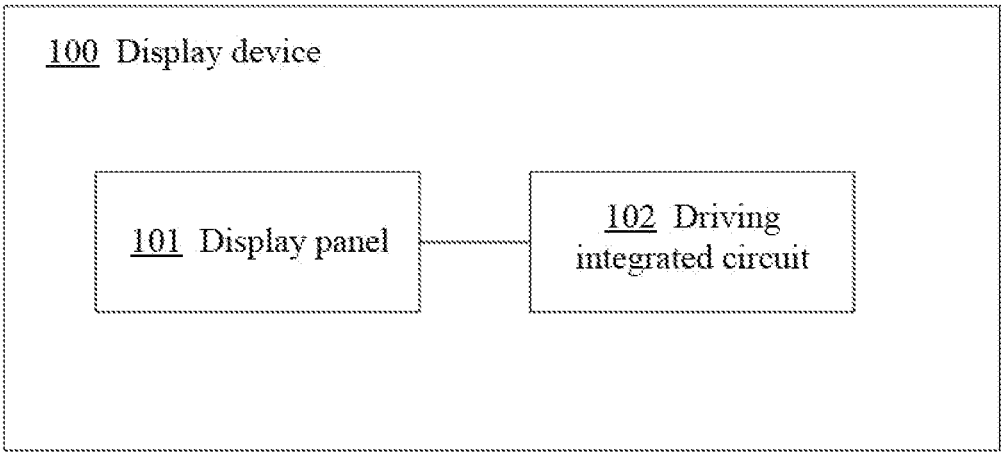
FIG. 7 is an application block diagram of a display device according to an embodiment of the present application.

As another embodiment of the present application, as shown in FIG. 7, disclosed is a display device 100, including the display panel 101.

The panel in the present application may be a Twisted Nematic (TN) panel, an In-Plane Switching (IPS) panel, and a Multi-domain Vertical Alignment (VA) panel, and of course, may also be other types of panels, if appropriate.

The contents above are further detailed descriptions of the present application in conjunction with optional specific embodiments, and the specific implementation of the present application is not limited to these descriptions. It will be apparent to those skilled in the art that various simple deductions or substitutions may be made without departing from the spirit of the present application, and should be considered to be within the scope of protection of the present application.

What is claimed is:

1. A display panel, comprising:

a substrate comprising a display region and a non-display region; and a plurality of data lines, a plurality of gate lines, and a plurality of pixels, wherein the display region and the non-display region is disposed on the substrate, wherein the pixels comprise sub-pixels of different colors respectively disposed along the direction of the gate lines, wherein the pixels adopt a two-column reverse driving manner, wherein: each row of the pixels comprises a plurality of pixel groups; each of the plurality of pixel groups comprises an anterior first column of pixels and a posterior second column of pixels adjacent to each other; the first column of pixels and the second column of pixels are connected to the same data line; and the first column of pixels and the second column of pixels are connected to two different gate lines, wherein the polarities of data driving signals adopted by each pixel group and an adjacent pixel group in each row of the pixels are opposite, wherein the data lines comprise a first data line coupled to the first column of pixels and a second data line coupled to the second column of pixels, wherein a line width of the first data line is greater than a line width of the second data line, wherein: the polarities of data driving voltages corresponding to the first column of pixels and the second column of pixels are the same; the first column of pixels is an odd-numbered column of pixels; and the second column of pixels is an even-numbered column of pixels, wherein the data lines comprise an odd-numbered column of data lines coupled to the odd-numbered column of pixels and an even-numbered column of data lines coupled to the even-numbered column of pixels, wherein a line width of the odd-numbered column of data lines is greater than a line width of the even-numbered column of data lines, wherein wirings of the gate lines and the data lines are of a single-layer metal, alloy or laminated structure, and wherein: a wiring of the odd-numbered column of data lines and a wiring of the even-numbered column of data lines are made of different materials; and the electrical resistivity of the wiring of the odd-numbered column of data lines is less than the electrical resistivity of the wiring of the even-numbered column of data lines.

2. The display panel according to claim 1, wherein: the line width of the odd-numbered column of data lines is at least equal to 2 μm and no more than 20 μm; and the line width of the even-numbered column of data lines is at least equal to 2 μm and no more than 20 μm.

3. The display panel according to claim 1, wherein a difference between the line width of the odd-numbered column of data lines and the line width of the even-numbered column of data lines is at least equal to 1 μm and no more than 5 μm.

4. The display panel according to claim 3, wherein the difference is one of 1 μm, 2 μm, or 3 μm.

5. The display panel according to claim 1, wherein the odd-numbered column of data lines and the even-numbered column of data lines are combined into one data line in the non-display region and connected to a driving integrated circuit.

6. A display panel, comprising:

a substrate comprising a display region and a non-display region; and a plurality of data lines, a plurality of gate lines, and a plurality of pixels, wherein the display region and the non-display region is disposed on the substrate, wherein the pixels comprise sub-pixels of different colors respectively disposed along the direction of the gate lines, wherein the pixels adopt a two-column reverse driving manner, wherein: each row of the pixels comprises a plurality of pixel groups; each of the plurality of pixel groups comprises an anterior first column of pixels and a posterior second column of pixels adjacent to each other; the first column of pixels and the second column of pixels are connected to the same data line; and the first column of pixels and the second column of pixels are connected to two different gate lines, wherein the polarities of data driving signals adopted by each pixel group and an adjacent pixel group in each row of the pixels are opposite, wherein: the polarities of data driving voltages corresponding to the first column of pixels and the second column of pixels are the same; the first column of pixels is an odd-numbered column of pixels; and the second column of pixels is an even-numbered column of pixels, wherein the data lines comprise an odd-numbered column of data lines coupled to the odd-numbered column of pixels and an even-numbered column of data lines coupled to the even-numbered column of pixels, wherein the odd-numbered column of data lines and the even-numbered column of data lines are combined into one data line in the non-display region and connected to a driving integrated circuit, wherein: a line width of the odd-numbered column of data lines is at least equal to 2 μm and no more than 20 μm; and the line width of the even-numbered column of data lines is at least equal to 2 μm and no more than 20 μm, wherein the line width of the odd-numbered column of data lines is greater than the line width of the even-numbered column of data lines, wherein a difference between the line width of the odd-numbered column of data lines and the line width of the even-numbered column of data lines is one of 1 μm, 2 μm, or 3 μm, wherein wirings of the gate lines and the data lines are of a single-layer metal, alloy or laminated structure, and wherein: a wiring of the odd-numbered column of data lines and a wiring of the even-numbered column of data lines are made of different materials; and the electrical resistivity of the wiring of the odd-numbered column of data lines is less than the electrical resistivity of the wiring of the even-numbered column of data lines.

7. A display device, comprising a display panel, the display panel comprising:

a substrate comprising a display region and a non-display region; and a plurality of data lines, a plurality of gate lines, and a plurality of pixels, wherein the display region and the non-display region is disposed on the substrate, wherein the pixels comprise sub-pixels of different colors respectively disposed along the direction of the gate lines, wherein the pixels adopt a two-column reverse driving manner, wherein: each row of the pixels comprises a plurality of pixel groups; each of the plurality of pixel groups comprises an anterior first column of pixels and a posterior second column of pixels adjacent to each other; the first column of pixels and the second column of pixels are connected to the same data line; and the first column of pixels and the second column of pixels are connected to two different gate lines, wherein the polarities of data driving signals adopted by each pixel group and an adjacent pixel group in each row of the pixels are opposite, wherein the data lines comprise a first data line coupled to the first column of pixels and a second data line coupled to the second column of pixels, wherein a line width of the first data line is greater than a line width of the second data line, wherein: the polarities of data driving voltages corresponding to the first column of pixels and the second column of pixels are the same; the first column of pixels is an odd-numbered column of pixels; and the second column of pixels is an even-numbered column of pixels, wherein the data lines comprise an odd-numbered column of data lines coupled to the odd-numbered column of pixels and an even-numbered column of data lines coupled to the even-numbered column of pixels, wherein a line width of the odd-numbered column of data lines is greater than a line width of the even-numbered column of data lines, wherein wirings of the gate lines and the data lines are of a single-layer metal, alloy or laminated structure, and wherein: a wiring of the odd-numbered column of data lines and a wiring of the even-numbered column of data lines are made of different materials; and the electrical resistivity of the wiring of the odd-numbered column of data lines is less than the electrical resistivity of the wiring of the even-numbered column of data lines.

8. The display device according to claim 7, wherein: the line width of the odd-numbered column of data lines is at least equal to 2 μm and no more than 20 μm; and the line width of the even-numbered column of data lines is at least equal to 2 μm and no more than 20 μm.

9. The display device according to claim 7, wherein a difference between the line width of the odd-numbered column of data lines and the line width of the even-numbered column of data lines is at least equal to 1 μm and no more than 5 μm.

10. The display device according to claim 9, wherein the difference is one of 1 μm, 2 μm, or 3 μm.

11. The display device according to claim 7, wherein the odd-numbered column of data lines and the even-numbered column of data lines are combined into one data line in the non-display region and connected to a driving integrated circuit.

* * * * *